US009577385B1

(12) United States Patent
Lin

(10) Patent No.: US 9,577,385 B1
(45) Date of Patent: Feb. 21, 2017

(54) ELECTRICAL CONNECTOR FOR CONNECTING A CABLE

(71) Applicant: LOTES CO., LTD, Keelung (TW)

(72) Inventor: Wen Wei Lin, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 14/920,149

(22) Filed: Oct. 22, 2015

(30) Foreign Application Priority Data

Aug. 14, 2015 (CN) ..... 2015 2 0612209 U

(51) Int. Cl.

| | |
|---|---|
| ***H01R 13/6585*** | (2011.01) |
| ***H01R 24/60*** | (2011.01) |
| *H01R 107/00* | (2006.01) |
| *H01R 13/41* | (2006.01) |
| *H01R 9/00* | (2006.01) |

(52) U.S. Cl.
CPC ..... *H01R 13/6585* (2013.01); *H01R 24/60* (2013.01); *H01R 9/00* (2013.01); *H01R 13/41* (2013.01); *H01R 2107/00* (2013.01)

(58) Field of Classification Search
CPC ..... H01R 13/41; H01R 9/00
USPC ..... 439/733.1, 76.1, 676, 660, 872, 607.01
See application file for complete search history.

(56) References Cited

U.S. PATENT DOCUMENTS 7,591,691 B2 * 9/2009 Lappoehn ..... H01R 13/422 439/733.1
8,684,769 B2 * 4/2014 Kao ..... H01R 13/6471 439/607.28

* cited by examiner

*Primary Examiner* — Abdullah Riyami
*Assistant Examiner* — Justin Kratt
(74) *Attorney, Agent, or Firm* — Locke Lord LLP; Tim Tingkang Xia, Esq.

(57) ABSTRACT

An electrical connector used for mating a mating connector includes an insulating body having multiple terminal slots in communication with an insertion space, multiple terminals, an insulating block. Each terminal slot has at least one side wall from which a depressed portion is depressed, the depressed portion is laterally in communication with the terminal slot. Each terminal has a connection portion connected to a contact portion and a soldering portion, a stopping portion protrudes from the connection portion and is located at the depressed portion. The insulating block is insert molded at a back end of the insulating body. A protruding portion protrudes from a front end of the insulating block and enters the depressed portion. The stopping portion is stopped in front of the protruding portion.

19 Claims, 6 Drawing Sheets

ELECTRICAL CONNECTOR FOR CONNECTING A CABLE

CROSS-REFERENCE TO RELATED APPLICATION

This non-provisional application claims priority under 35 U.S.C. §119(a) on Patent Application No. 201520612209.3 filed in P.R. China on Aug. 14, 2015, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector, and more particularly to an electrical connector for connecting a cable.

BACKGROUND OF THE INVENTION

An existing electrical connector is used for mating with a mating connector and connected to a cable, and includes an insulating body, multiple terminals fixed to the insulating body, and a metal shell wrapping the insulating body. An insertion space is depressed from a front end of the insulating body and provided for the mating connector to be inserted therein. Multiple terminal slots are provided to run through from a back end surface of the insulating body forward. The multiple terminals are correspondingly inserted into the multiple terminal slots from rear to front, and a front end of each of the terminals is provided with a contact portion stretched into the insertion space to mate a mating terminal of the mating connector. A back end of the insulating body is provided with a circuit board, a back end of each of the terminals has a soldering portion for being soldered to one end of the circuit board, and the cable is soldered to another end of the circuit board, so that the terminals are electrically connected to the cable. At the back end of the insulating body, an insulating block is formed by insert molding, and the insulating block wraps and fixes the soldering portion, the circuit board and a front end of the cable, thereby fixing the electrical connector to the cable. The length of the terminals is relatively long, and the thickness thereof is relatively thin, and therefore the corresponding length of the terminal slot is relatively long, and the width thereof is relatively narrow, so as to conveniently receive and fix the terminals. However, when the insulating body is injection molded, because the length of the terminal slot is relatively long, and the width thereof is relatively narrow, the strength of a pin of a die is relatively weak, deflection is easily generated in a forming process, and thereby the formed terminal slot is easily deflected, which affects smooth insertion of the terminal.

To resolve the foregoing problem, a depressed portion is depressed from each of two sides of the terminal slot, so as to increase the width of the terminal slot, and meanwhile uses a relatively thick pin to form the terminal slot. Because the strength of the pin is enhanced, the pin is not easily deflected or deformed in the forming process, thereby ensuring that the formed terminal slot is not easily deflected, so that the terminal can be smoothly inserted into the terminal slot.

However, because the depressed portion is depressed from each of the two sides of the terminal slot, and the corresponding terminal is only received in the terminal slot, but do not extend to enter the depressed portion. That is, the terminals can only fill space of the terminal slots, but cannot fill space of the depressed portion. Because the depressed portion is in communication with the entire terminal slot, when the insulating block is insert molded, each of the terminals can only stop flowing plastic from entering the corresponding terminal slot from the back end of the insulating body, but cannot stop the flowing plastic from entering the depressed portion from the back end of the insulating body, then flowing into the terminal slot through the depressed portion and then flowing into the insertion space, so that elastic deformation space of the contact portion is reduced, which affects elastic mating between the contact portion and the mating terminal, and the flowing plastic is stacked to the insertion space, which hinders the mating connector from being inserted into the insertion space, thereby severely affecting electrical connection between the electrical connector and the mating connector.

Therefore, a heretofore unaddressed need exists in the art to address the aforementioned deficiencies and inadequacies.

SUMMARY OF THE INVENTION

In one aspect, the present invention relates to an electrical connector that has good electrical connection performance.

In one embodiment, an electrical connector includes an insulating body, multiple terminals, and an insulating block. A front end of the insulating body has an insertion space. The insulating body is provided with multiple terminal slots in communication with the insertion space. Each of the terminal slots has two side walls disposed opposite to each other. A depressed portion is concavely formed from at least one of the side walls, and the depressed portion is laterally in communication with the terminal slot. The multiple terminals are correspondingly assembled to the multiple terminal slots. Each of the terminals has one end provided with a contact portion located in the insertion space, and the other end provided with a soldering portion protruding from a back end of the insulating body. The terminal has a connection portion connected to the contact portion and the soldering portion, and a stopping portion protrudes from at least one side of the connection portion toward the depressed portion, so that the stopping portion is located at the depressed portion. The insulating block is insert molded at the back end of the insulating body, and wraps the soldering portions. A protruding portion protrudes from a front end of the insulating block forward and enters the depressed portion, and the stopping portions are stopped in front of the protruding portions.

In one embodiment, each of the stopping portions punctures a plate surface of the corresponding connection portion and extends backward.

In one embodiment, each of the depressed portions is depressed from a back end surface of the insulating body forward, and a distance exists between the depressed portion and each of a top wall and a bottom wall of the terminal slot.

In one embodiment, depressed portions are separately depressed from the two side walls of each of the terminal slots, stopping portions protrude separately from two opposite sides of the connection portion of each of the terminals along opposite directions, the two stopping portions are disposed along a direction from front to rear, and the two stopping portions correspondingly resist inner wall surfaces of the two depressed portions.

In one embodiment, an accommodating space is depressed from a back end surface of the insulating body forward, a circuit board is partially accommodated in the accommodating space, the soldering portion of each of the terminals is soldered to one end of the circuit board, and the insulating block, the soldering portions and the circuit board are insert molded integrally, and fill the accommodating space.

In one embodiment, for each of the terminals, the connection portions is provided with a retaining portion close to the soldering portion, the retaining portion and an inner wall surface of the corresponding terminal slot are in interference fit, and the stopping portion protrudes from a plate surface of the retaining portion.

In one embodiment, for each terminal, a supporting portion protrudes from the connection portion close to the contact portion, the supporting portion is located between the contact portion and the retaining portion, the supporting portion protrudes toward a horizontal center surface of the insulating body, and the supporting portion resists the inner wall surface of the corresponding terminal slot.

In one embodiment, two rows of terminal slots are provided to run through the insulating body along a direction from front to rear, the multiple terminals are correspondingly located at the two rows of terminal slots and are arranged into an upper row and a lower row in the insulating body, a shielding sheet is inserted into the insulating body and is located between the upper and lower rows of terminals, and a plate surface of each of the terminals perpendicular to a plate surface of the shielding sheet.

In one embodiment, the shielding sheet has a base portion located at a back end of the terminal slots, a latch arm extends from each of two opposite sides of the base portion forward, a hollowing portion is depressed from each of two opposite sides of the insulating body and is in communication with the insertion space, the latch arms are accommodated in the hollowing portions and stretched into the insertion space, two retaining arms protrude from the base portion between the two latch arms, each of the retaining arms is located between a terminal at the outermost side and a terminal adjacent to the outermost terminal, the insulating body is provided with two fixing slots between the two rows of terminal slots, and the two retaining arms are correspondingly fixed to the two fixing slots.

In one embodiment, the electrical connector further includes a metal shell wrapping the insulating body. The metal shell is formed in a drawing manner. The insulating block is partially located in the metal shell. The metal shell, the insulating body and the insulating block are fixed as a unity.

In one embodiment, an electrical connector for mating a mating connector includes an insulating body and multiple terminals. A front end of the insulating body has an insertion space, used for the mating connector to be inserted therein. The insulating body is provided with multiple terminal slots in communication with the insertion space. Each of the terminal slots has two side walls disposed opposite to each other, a depressed portion is depressed from at least one of the side walls, and the depressed portion is laterally in communication with the terminal slot. The multiple terminals are correspondingly assembled to the multiple terminal slots. Each of the terminals has one end provided with a contact portion located in the insertion space and mating the mating connector, and the other end provided with a soldering portion protruding from the insulating body. The terminal has a connection portion located between the contact portion and the soldering portion, a stopping portion protrudes from at least one side of the connection portion toward the depressed portion, and the stopping portion resists an inner wall surface of the depressed portion.

In one embodiment, each of the stopping portions punctures a plate surface of the connection portion and extends backward.

In one embodiment, for each terminal slot, the depressed portion is depressed from a back end surface of the insulating body forward, and a distance exists between the depressed portion and each of a top wall and a bottom wall of the terminal slot.

In one embodiment, for each terminal slot, two depressed portions are separately depressed from the two side walls of the terminal slots, stopping portion protrude separately from two opposite sides of the connection portion of the corresponding terminal along opposite directions, the two stopping portions are disposed along a direction from front to rear, and the two stopping portions correspondingly resist inner wall surfaces of the two depressed portions.

In one embodiment, an accommodating space is depressed from a back end surface of the insulating body forward, a circuit board is partially accommodated in the accommodating space, and the soldering portions of the terminals are soldered to one end of the circuit board. An insulating block, the soldering portions and the circuit board are insert molded integrally, and fill the accommodating space. A front end of the insulating block is integrally formed with protruding portions entering the depressed portion, and the stopping portions are stopped respectively at a front end of the protruding portions.

In one embodiment, a cable is soldered to another end of the circuit board, so as to be electrically connected to the terminals, and the insulating block wraps and fixes a front end of the cable.

In one embodiment, for each terminal, the connection portion is provided with a retaining portion close to the soldering portion, the retaining portion and an inner wall surface of the terminal slot are in interference fit, and the stopping portion protrudes from a plate surface of the retaining portion.

In one embodiment, for each terminal, a supporting portion protrudes from the connection portion close to the contact portion, the supporting portion is located between the contact portion and the retaining portion, the supporting portion protrudes toward a horizontal center surface of the insulating body, and when the mating connector is not inserted into the insertion space, the supporting portion resists the inner wall surface of the terminal slot.

In one embodiment, two rows of terminal slots are provided to run through the insulating body along a direction from front to rear, the multiple terminals are correspondingly located at the two rows of terminal slots and are arranged into two rows in the insulating body, a shielding sheet is inserted into the insulating body and is located between the two rows of terminals, and a plate surface of each of the terminals perpendicular to a plate surface of the shielding sheet.

In one embodiment, the shielding sheet has a base portion located at a back end of the terminal slot, a latch arm extends from each of two opposite sides of the base portion forward, a hollowing portion is depressed from each of two opposite sides of the insulating body and is in communication with the insertion space, the latch arms are accommodated in the hollowing portions and stretched into the insertion space to cooperate with the mating connector, two retaining arms protrude from the base portion between the two latch arms, each of the retaining arms is located between a terminal at the outermost side and a terminal adjacent to the terminal, the insulating body is provided with two fixing slots between the two rows of terminal slots, and the two retaining arms are correspondingly fixed to the two fixing slots.

Compared with the related art, certain embodiments of the present invention have the following beneficial advantages. For each terminal and the corresponding terminal slot, the stopping portion protrudes from a side of the connection portion toward the depressed portion, the stopping portion is located at the depressed portion and resists the inner wall surface of the depressed portion, and when the insulating block is insert molded, the terminal stops plastic from entering the terminal slot from the back end of the insulating body, the stopping portion is stopped in front of the protruding portion, to prevent the plastic from crossing the stopping portion to flow into the terminal slot from the front end of the depressed portion and then flow into the insertion space, thereby ensuring stable elastic mating between the contact portion and the mating connector, and preventing the flowing plastic from flowing out from the depressed portion and being stacked to the insertion space, so that the mating connector can be smoothly inserted into the insertion space, thereby ensuring good electrical connection between the electrical connector and the mating connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention.

Wherever possible, the same reference numbers are used throughout the drawings to refer to the same or like elements of an embodiment.

DETAILED DESCRIPTION OF THE INVENTION

Figure 1:
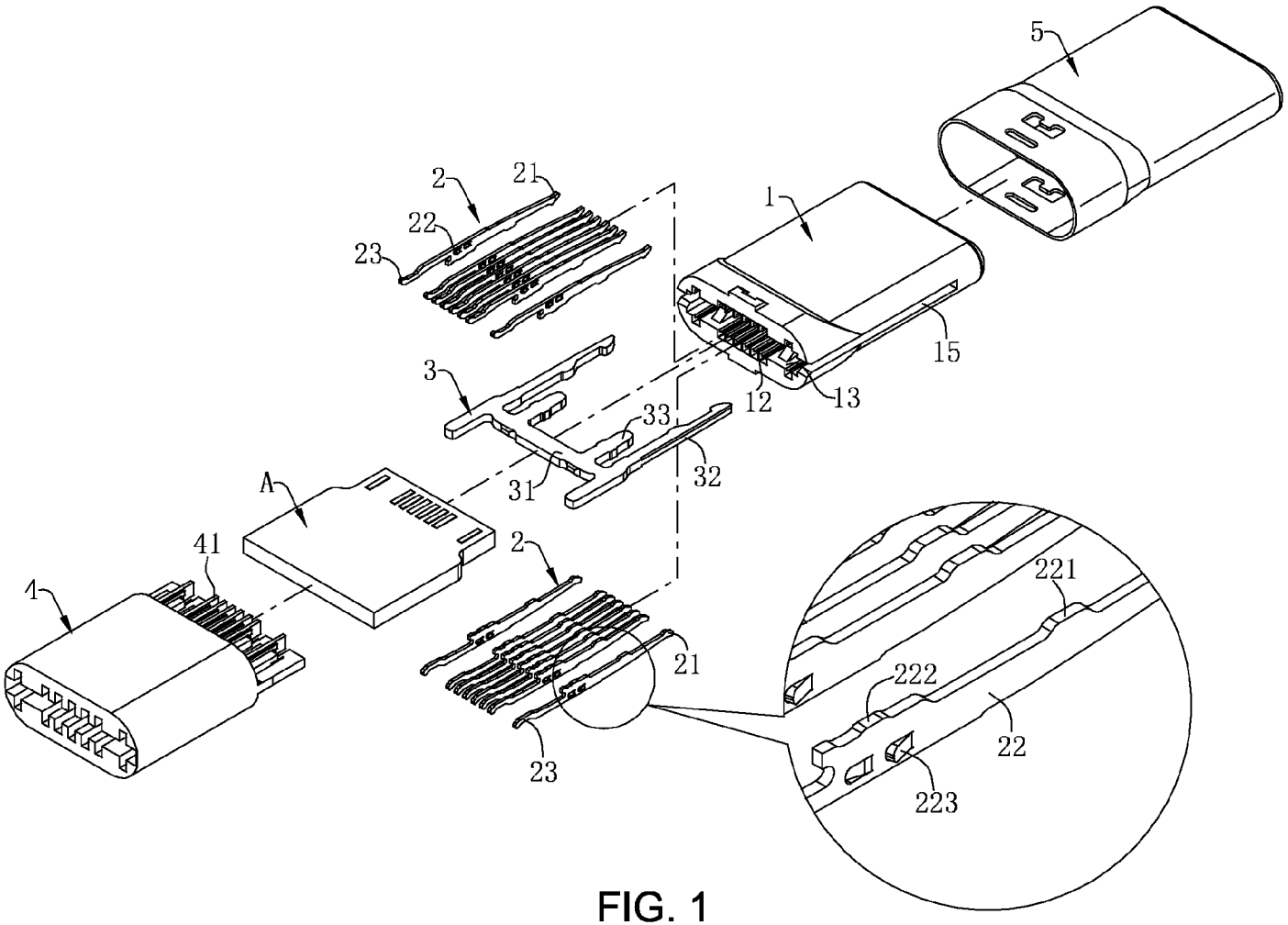
FIG. 1 is a schematic three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-6. In accordance with the purposes of this invention, as embodied and broadly described herein, this invention, in one aspect, relates to an electrical connector.

Figure 3:
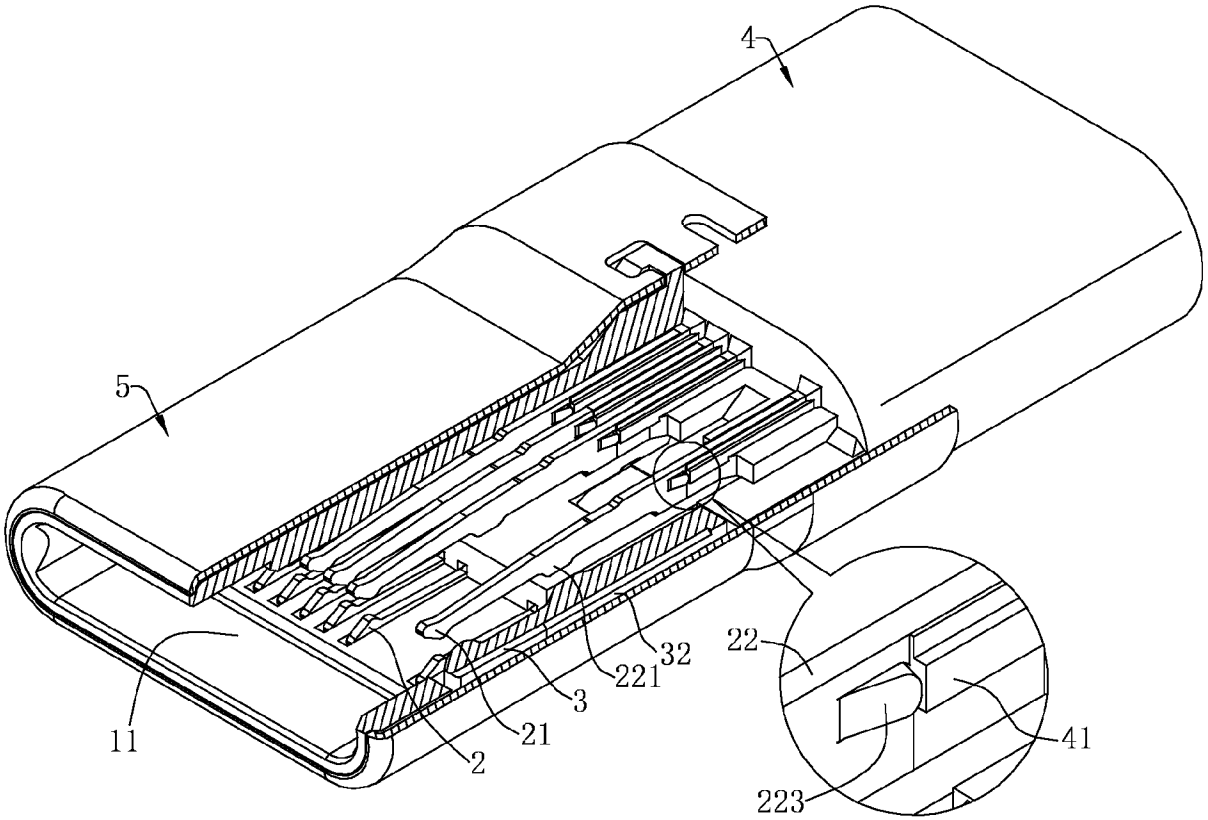
FIG. 3 is a schematic partial three-dimensional sectional view of an electrical connector according to one embodiment of the present invention.
Figure 6:
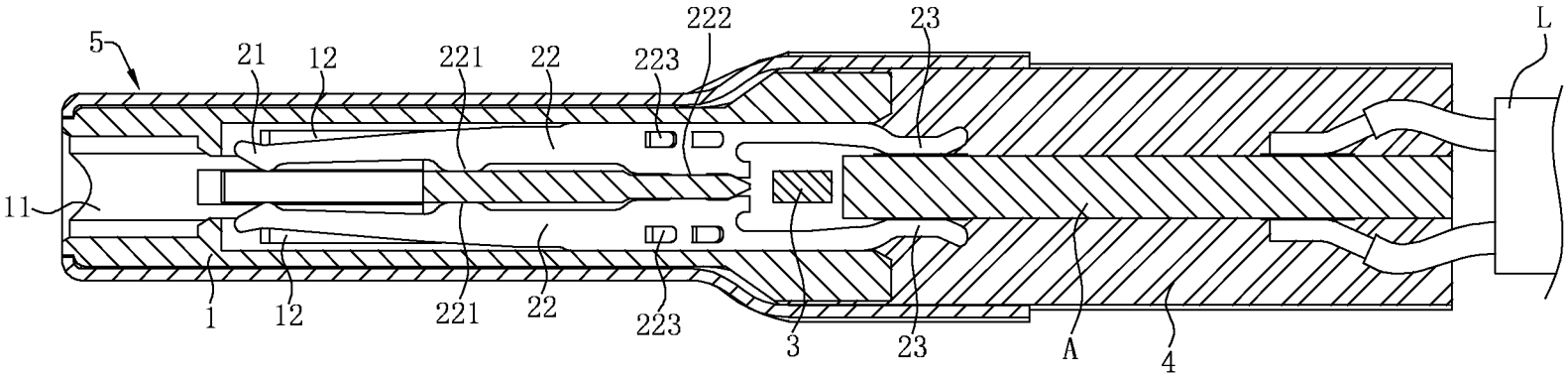
FIG. 6 is a schematic sectional view along a direction B-B in FIG. 4.

As shown in FIGS. 1, 3 and 6, an electrical connector 100 according to one embodiment of the present invention is used for mating a mating connector (not shown) and electrically connected to a cable L. The electrical connector 100 includes an insulating body 1, multiple terminals 2, a shielding sheet 3, an insulating block 4, and a metal shell 5. A front end of the insulating body 1 has an insertion space 11 used for the mating connector to be inserted therein. The insulating body 1 has multiple terminal slots 12, and the multiple terminals 2 are correspondingly assembled to the multiple terminal slots 12. The shielding sheet 3 is inserted into and fixed to the insulating body 1. The insulating block 4 is insert molded at a back end of the insulating body 1 for fixing the cable L. The metal shell 5 wraps the insulating body 1, and partially wraps the insulating block 4.

As shown in FIGS. 1 and 4-6, the insertion space 11 is depressed from the front end of the insulating body 1 backward and used for the mating connector to be inserted therein. An accommodating space 13 is depressed from the back end surface of the insulating body 1 forward. The accommodating space 13 is used for accommodating the insulating block 4. The insulating body 1 is provided with the multiple terminal slots 12 between the insertion space 11 and the accommodating space 13, and the multiple terminal slots 12 are all in communication with the insertion space 11 and the accommodating space 13. That is, the multiple terminal slots 12 run through the insulating body 1 along a direction from front to rear. Each of the terminal slots 12 has two side walls 121 disposed opposite to each other. The terminal slot 12 is formed between the two side walls 121 and provided for the terminal 2 to be inserted therein. The two side walls 121 are disposed parallel to each other along a vertical direction. A depressed portion 122 is laterally depressed from at least one of the side walls 121. The depressed portion 122 is laterally in communication with the terminal slot 12. The depressed portion 122 is depressed from the back end surface of the insulating body 1 forward, but does not run through the front end surface of the insulating body 1. The depressed portion 122 is in communication with the terminal slot 12, and the terminal slot 12 is in communication with the insertion space 11. That is, the depressed portion 122 is in communication with the insertion space 11. In this embodiment, the depressed portion 122 is laterally depressed from each of the two side walls 121 of each of the terminal slots 12. The two depressed portions 122 of each terminal 12 are symmetrically disposed along the center line of the terminal slot 12 in the vertical direction. A distance exists between each of the depressed portions 122 and each of a top wall and a bottom wall of the terminal slot 12. That is, each of the depressed portions 122 is depressed from a middle position of the corresponding side wall 121, and the terminal slot 12 and the depressed portions 122 are connected to form a "cross" shape. In other embodiments, the depressed portion 122 may be laterally depressed from only one of the side walls 121 of the corresponding terminal slot 12, as long as it is ensured that the depressed portion 122 is laterally in communication with the terminal slot 12.

Figure 4:
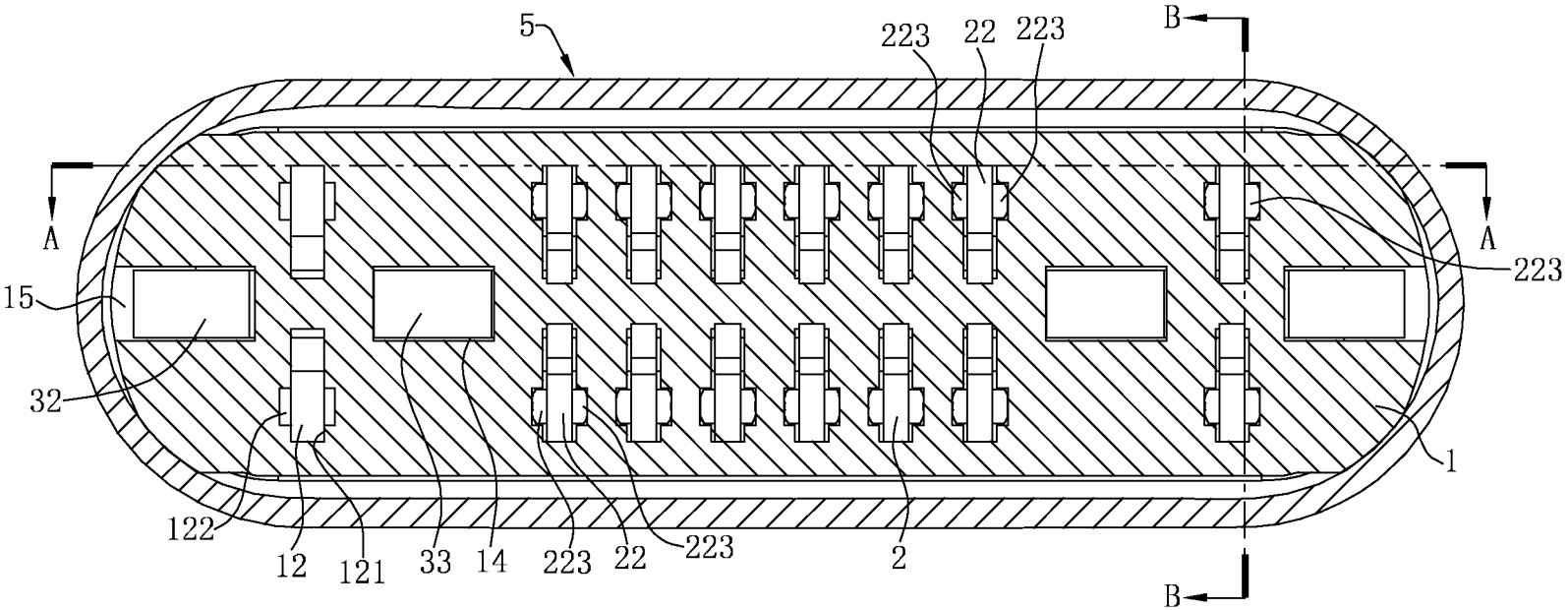
FIG. 4 is a schematic partial sectional view of the electrical connector according to one embodiment of the present invention.
Figure 5:
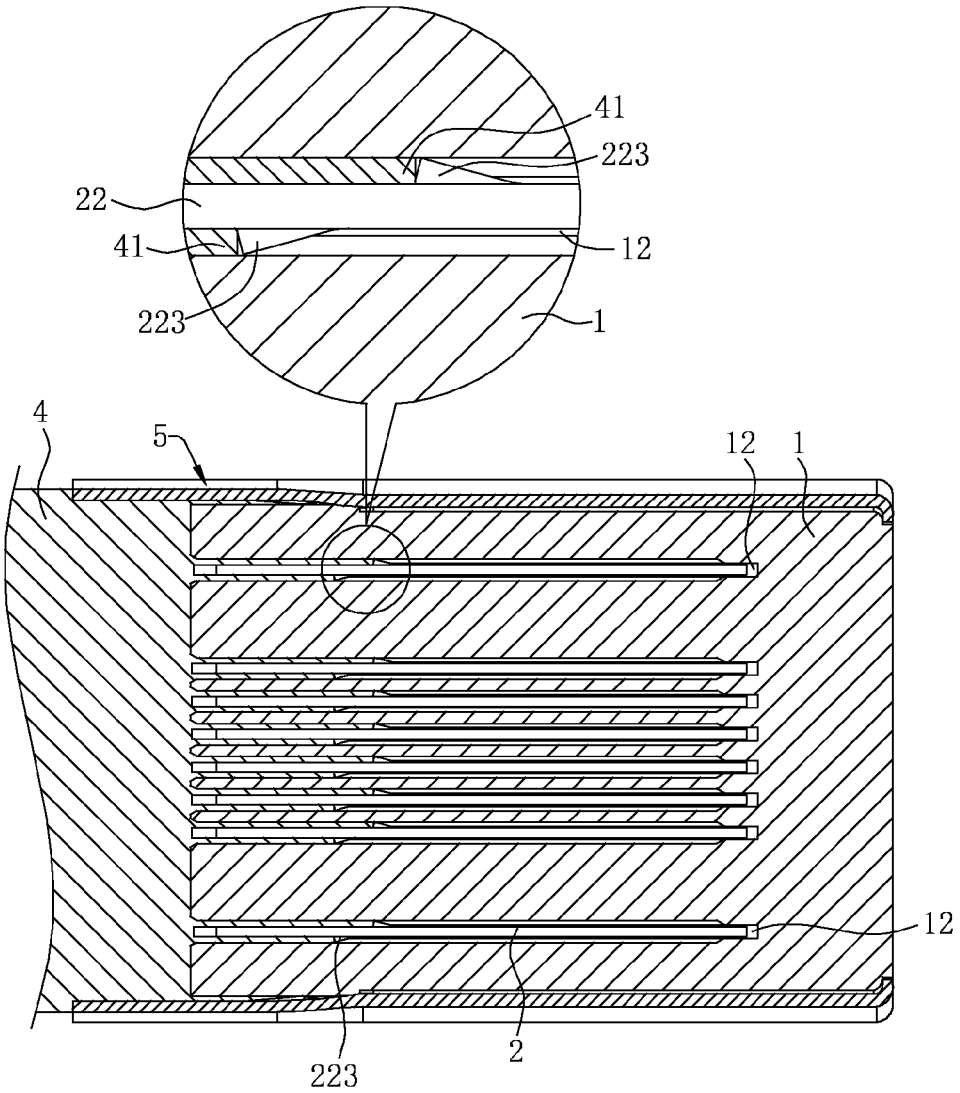
FIG. 5 is a schematic sectional view along a direction A-A in FIG. 4.

As shown in FIGS. 1, 4 and 5, two rows of terminal slots 12 are provided to run through the insulating body 1 along a direction from front to rear. The multiple terminals 2 are correspondingly located at the two rows of terminal slots 12 and are arranged into an upper row and a lower row in the insulating body 1. The insulating body 1 has two fixing slots 14 between the two rows of terminal slots 12, and each of the fixing slots 14 is located, along a direction from left to right, between a terminal slot 12 at the outermost side and a terminal slot 12 adjacent to the outermost terminal slot 12. A hollowing portion 15 is depressed from each of two opposite sides of the insulating body 1, and the hollowing portions 15 are located at an outer side surface of the insulating body 1. The insulating body 1 is vertically symmetrically disposed along a center surface of the insulating body 1 in the horizontal direction, and the insulating body 1 is horizontally symmetrically disposed along a center surface of the insulating body 1 in the vertical direction.

As shown in FIGS. 1 and 4-6, the terminals 2 are formed in a blanking manner, so that each of the terminals 2 is assembled to the corresponding terminal slot 12 along a direction from back to front. The multiple terminals 2 are received in and fixed to the multiple terminal slots 12, and are arranged into an upper row and a lower row in the insulating body 1. The shielding sheet 3 is located between the upper and lower rows of terminals 2. The upper and lower rows of terminals 2 are separately located at two opposite sides of the insertion space 11, and symmetrically distributed along the center surface of the insulating body 1 in the horizontal direction, so that the mating connector may be inserted in dual orientation. One end of each of the terminals 2 is provided with an elastic contact portion 21 located in the insertion space 11. The contact portions 21 of the upper and lower rows of terminals 2 are separately located at two sides of the insertion space 11 and mate the mating connector. The other end of each of the terminals 2 is provided with a soldering portion 23 passing through the accommodating space 13 and protruding from the back end of the insulating body 1. The soldering portions 23 are used for being soldered to one end of a circuit board A, and the cable L is soldered to another end of the circuit board A, so that the terminals 2 are correspondingly electrically connected to the cable L. Each terminal 2 has a connection portion 22 connected to the contact portion 21 and the soldering portion 23. The connection portion 22 is located between the contact portion 21 and the soldering portion 23. A stopping portion 223 protrudes from at least one side of the connection portion 22 toward the depressed portion 122. The stopping portion 223 punctures a plate surface of the connection portion 22 and extends backward. The stopping portion 223 is located at the depressed portion 122, and the stopping portion 223 resists the inner wall surface of the depressed portion 122 backward. When the insulating block 4 is insert molded, because gaps between an upper end and a lower end of each of the terminals 2 and a top wall and a bottom wall of the corresponding terminal slot 12 are very tiny, plastic does not enter the terminal slots 12 easily, and therefore the upper end and the lower end of the terminals 2 can stop the plastic from entering the terminal slots 12 from the back end of the insulating body 1. That is, the terminals 2 stop the plastic from entering the corresponding terminal slots 12 from the back end of the insulating body 1. Meanwhile, the stopping portions 223 resist the inner wall surface of the corresponding depressed portions 122, so that the flowing plastic can be stopped from flowing into the terminal slots 12 from the front end of the depressed portions 122 and then flowing into the insertion space 11, thereby ensuring stable elastic mating between the contact portions 21 and the mating connector. Moreover, the flowing plastic is prevented from flowing out from the depressed portions 122 and being stacked to the insertion space 11, so that the mating connector can be smoothly inserted into the insertion space 11, thereby ensuring good electrical connection between the electrical connector 100 and the mating connector, and therefore the electrical connector 100 has good electrical connection performance.

As shown in FIGS. 1, 3 and 4, in this embodiment, each of the stopping portions 223 punctures the plate surface of the corresponding connection portion 22. In other embodiments, each of the stopping portions 223 may be a bump protruding from the plate surface of the connection portion 22, as long as it is ensured that the stopping portion 223 may stop the plastic from entering the corresponding terminal slot 12 from the depressed portion 122. In this embodiment, for each terminal 2 and its corresponding terminal slot 12, each of the two side walls 121 of the terminal slot 12 is provided with the depressed portion 122, and therefore the stopping portions 223 separately protrude from two opposite sides of the connection portion 22 of the terminal 2 along opposite directions and correspond to the two depressed portions 122, the two stopping portions 223 are disposed along a direction from front to rear, and the two stopping portions 223 are correspondingly stopped at inner wall surfaces of the two depressed portions 122, to prevent the plastic from flowing into the terminal slot 12 from the depressed portions 122 and then flowing into the insertion space 11. In other embodiments, for each terminal 2 and its corresponding terminal slot 12, the stopping portions 223 may protrude from only a side of the connection portion 22, as long as it is ensured that the stopping portion 223 is correspondingly located at a corresponding depressed portion 122.

As shown in FIGS. 1, 3 and 6, for each terminal 2 and its corresponding terminal slot 12, the connection portion 22 is provided with a retaining portion 222 close to the soldering portion 23. The retaining portion 222 is in interference fit with the inner wall surface of the terminal slot 12, to fix the terminal 2 to the terminal slot 12. Both of the two stopping portions 223 of the terminal 2 protrude from a middle position of the plate surface of the retaining portion 222 backward. A supporting portion 221 protrudes from the connection portion 22 close to the contact portion 21. The supporting portion 221 is located between the contact portion 21 and the retaining portion 222. The supporting portion 221 protrudes toward a horizontal center surface of the insulating body 1, and resists the inner wall surface of the terminal slot 12. That is, the supporting portion 221 of each of the upper row of terminals 2 resists the inner wall surface at the lower side of the corresponding upper row of terminal slot 12, and the supporting portion 221 of each of the lower row of terminals 2 resists the inner wall surface at the upper side of the corresponding lower row of terminal slot 12, so as to support upper and lower rows of contact portions 21, prevent the upper and lower rows of contact portions 21 from excessively slanting toward the horizontal center surface of the insulating body 1 to cause an excessively small distance between the upper and lower rows of contact portions 21, and avoid that when the mating connector is inserted into the insertion space 11, the contact portion 21 is damaged to cause pin kneeling of the terminal 2. Moreover, because the supporting portion 221 is located between the contact portion 21 and the retaining portion 222, a forward force of the contact portion 21 during elastic mating is increased, so that mating between the contact portion 21 and the mating connector is more stable.

Figure 2:
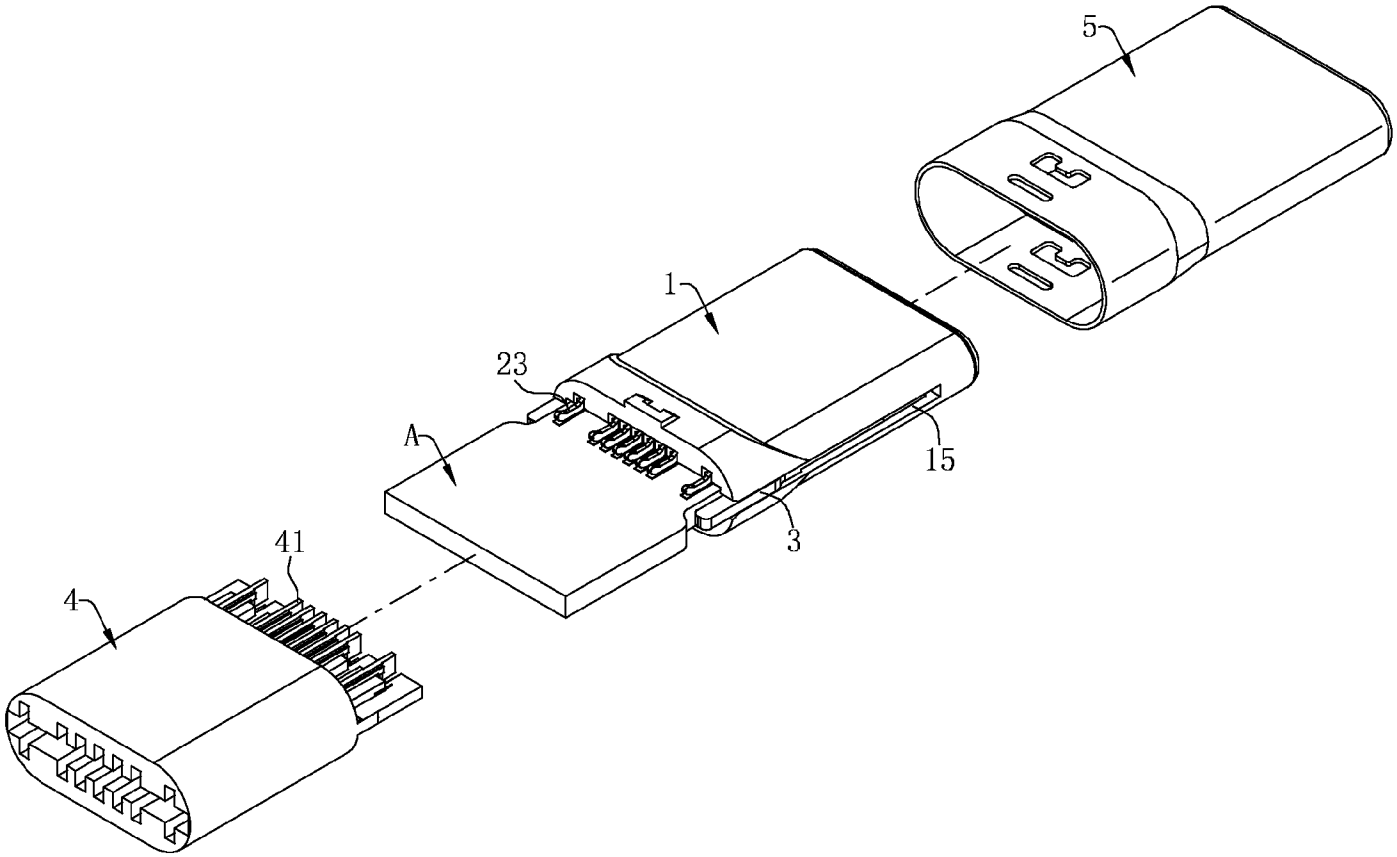
FIG. 2 is a schematic partial three-dimensional assembly view of an electrical connector according to one embodiment of the present invention.

As shown in FIGS. 1, 2 and 4, the shielding sheet 3 has a base portion 31 located at the back end of the terminal slots 12. That is, the base portion 31 is accommodated in the accommodating space 13. The base portion 31 is located between the upper and lower rows of terminals 2. A plate surface of the base portion 31 is perpendicular to a plate surface of the terminals 2. A latch arm 32 extends from each of two opposite sides of the base portion 31 forward. The latch arms 32 are accommodated in the hollowing portions 15, stretched into the insertion space 11, and used for cooperating with the mating connector, so as to increase a retaining force between the electrical connector 100 and the mating connector. Two retaining arms 33 protrude from the base portion 31 between the two latch arms 32 forward. The two retaining arms 33 and the two latch arms 32 extend in a same direction. The length of the retaining arms 33 is less than the length of the latch arms 32, and the two retaining arms 33 are correspondingly fixed to the two fixing slots 14, and used for fixing the shielding sheet 3 to the insulating body 1. Each of the retaining arms 33 is located between the terminal 2 at the outermost side and a terminal 2 adjacent to the outermost terminal 2. The retaining arms 33 is disposed in such a way that a distance between the terminal 2 at the outermost side and the terminal 2 adjacent to the outmost terminal 2 of each row of terminals 2 is greater than a distance between any other two adjacent terminals 2. The shielding sheet 3 cooperates with the mating connector so as to be grounded, thereby shielding signal interference between the upper and lower rows of terminals 2, and ensuring high frequency performance of the electrical connector 100.

As shown in FIGS. 1, 3, 5 and 6, the insulating block 4 is insert molded at the back end of the insulating body 1, and fills the accommodating space 13. The insulating block 4 wraps and fixes the soldering portions 23, the circuit board A, and the front end of the cable L. That is, the soldering portions 23, the circuit board A, and the front end of the cable L are all fixed in the insulating block 4, so that the insulating block 4 fixes the electrical connector 100 and the cable L as a unity. When the insulating block 4 is formed, the flowing plastic enters the accommodating space 13 through the back end surface of the insulating body 1, and then enters the back end of the depressed portion 122 through the accommodating space 13. Because each of the stopping portions 223 resists the inner wall surface of the corresponding depressed portion 122, the flowing plastic is prevented from crossing the stopping portions 223 to enter the terminal slots 12 and then flow into the insertion space 11, so that the flowing plastic forms a protruding portion 41 only at the back end of each of the depressed portions 122. That is, a protruding portion 41 protrudes from the front end of the insulating block 4 forward and enters each of the depressed portions 122, and the stopping portions 223 are respectively stopped at the front end of the protruding portions 41, to prevent the protruding portions 41 from being further stretched into the depressed portions 122. The insulating block 4 is insert molded at the back end the insulating body 1, and fills the accommodating space 13, so that a foreign material can be prevented from entering the accommodating space 13 and then flowing into the terminal slots 12. Moreover, because the insulating block 4 is formed in an insert molding manner, production costs of the electrical connector 100 are reduced. Further, because the insulating block 4 does not need to be additionally assembled, the electrical connector 100 is assembled simply and conveniently.

As shown in FIGS. 1-3, the metal shell 5 is formed in a drawing manner, so that there is no gap on the surface of the metal shell 5, so as to prevent an external foreign material from entering the metal shell 5. The metal shell 5 completely wraps the insulating body 1, so that the electrical connector 100 has a good shielding effect. The top surface of the metal shell 5 is provided with a locking hole (not labeled) that is cooperatively fixed to a locking block (not labeled) of the insulating body 1. The metal shell 5 is fixed to the insulating body 1, the insulating block 4 is partially located at the metal shell 5, and the metal shell 5 fixes the insulating body 1 and the insulating block 4 as a unity.

As shown in FIGS. 1, 4 and 6, during assembly, at first, the multiple terminals 2 are inserted into the terminal slots 12 from rear to front in a riveting manner, so that for each terminal 2 and its corresponding slot 12, the connection portion 22 is accommodated in the terminal slot 12, the retaining portion 222 is in interference fit with the inner wall surface of the terminal slot 12, the stopping portion 223 resists the inner wall surface of the depressed portion 122, the supporting portion 221 resists the inner wall surface of the terminal slot 12, the contact portion 21 is stretched into the insertion space 11, and the soldering portion 23 passes through the accommodating space 13 and protrudes from the back end surface of the insulating body 1. Then, the shielding sheet 3 is inserted into the accommodating space 13 from rear to front, so that the shielding sheet 3 is located between the upper and lower rows of terminals 2. The two retaining arms 33 are aligned with and inserted into the two fixing slots 14, the base portion 31 is located at the back end of the terminal slots 12, the two latch arms 32 are accommodated in the hollowing portions 15 at two sides of the insulating body 1, and the front end of each of the latch arms 32 is stretched into the insertion space 11, thereby fixing the shielding sheet 3 to the insulating body 1. Then, the front end of the circuit board A is placed in the accommodating space 13, so that the soldering portions 23 are soldered to one end of the circuit board A, and the front end of the cable L is soldered to another end of the circuit board A. Further, the insulating block 4 is formed by insert molding between the back end of the insulating body 1 and the front end of the cable L. The stopping portions 223 resist the inner wall surfaces of the corresponding depressed portions 122, so as to stop the flowing plastic from entering the terminal slots 12 and then flowing into the insertion space 11, so that the flowing plastic forms the protruding portions 41 respectively at the back end of the stopping portions 223. The protruding portions 41 are respectively located in the depressed portions 122, and the stopping portions 223 are stopped at the front end of the protruding portions 41. Finally, the metal shell 5 is sleeved over the insulating body 1, so that the metal shell 5 completely wraps the insulating body 1, the insulating block 4 is partially located at the metal shell 5, and the metal shell 5 fixes the insulating body 1 and the insulating block 4 as a unity. When the mating connector is inserted into the insertion space 11, both the contact portions 21 and the front end of the latch arms 32 elastically urge the mating connector, so that the electrical connector 100 is well electrically connected to the mating connector. In this case, the supporting portions 221 are subject to an insertion force of the mating connector to move away from the horizontal center surface of the insulating body 1, but do not respectively resist the inner wall surfaces of the terminal slots 12, while the retaining portions 222 still respectively resist the inner wall surfaces of the terminal slots 12, thereby ensuring that the terminals 2 are respectively fixed to the terminal slots 12.

In summary, the electrical connector 100 according to certain embodiments of the present invention, among other things, has the following beneficial advantages.

(1) The stopping portions 223 are respectively located at the depressed portions 122, the stopping portions 223 resist the inner wall surface of the depressed portions 122 backward, and when the insulating block 4 is insert molded, the terminals 2 stops plastic from entering the terminal slots 12 from the back end of the insulating body 1, the stopping portions 223 stop the flowing plastic from flowing into the terminal slots 12 from the front end of the depressed portions 122 and then flowing into the insertion space 11, thereby ensuring stable elastic mating between the contact portions 21 and the mating connector, and preventing the flowing plastic from flowing out from the depressed portions 122 and being stacked to the insertion space 11, so that the mating connector can be smoothly inserted into the insertion space 11, thereby ensuring good electrical connection between the electrical connector 100 and the mating connector, and therefore the electrical connector 100 has good electrical connection performance.

(2) For each terminal 2 and its corresponding terminal slot 12, the supporting portion 221 is located between the contact portion 21 and the retaining portion 222, each supporting portion 221 protrudes toward the horizontal center surface of the insulating body 1, and resists the inner wall surface of the terminal slot 12, so as to support upper and lower rows of contact portions 21, prevent the upper and lower rows of contact portions 21 from excessively slanting toward the horizontal center surface of the insulating body 1 to cause an excessively small distance between the upper and lower rows of contact portions 21, and avoid that when the mating connector is inserted into the insertion space 11, the contact portion 21 is damaged to cause pin kneeling of the terminal 2. Moreover, because the supporting portion 221 is located between the contact portion 21 and the retaining portion 222, a forward force of the contact portion 21 during elastic mating is increased, so that mating between the contact portion 21 and the mating connector is more stable.

(3) The insulating block 4 is insert molded at the back end the insulating body 1, and fills the accommodating space 13, so that a foreign material can be prevented from entering the accommodating space 13 and then flowing into the terminal slots 12. Moreover, because the insulating block 4 is formed by insert molding, production costs of the electrical connector 100 are reduced. Further, because the insulating block 4 does not need to be additionally assembled, the electrical connector 100 is assembled simply and conveniently.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body, having an insertion space located at a front end thereof and a plurality of terminal slots in communication with the insertion space, wherein each of the terminal slots has two side walls disposed opposite to each other, a depressed portion is depressed from at least one of the side walls, and the depressed portion is laterally in communication with the terminal slot;

a plurality of terminals, respectively assembled to the terminal slots, wherein each of the terminals has one end provided with a contact portion located in the insertion space, and the other end provided with a soldering portion protruding from a back end of the insulating body, the terminal has a connection portion connected to the contact portion and the soldering portion, and a stopping portion protrudes from at least one side of the connection portion toward the depressed portion, so that the stopping portion is located at the depressed portion; and an insulating block, insert molded at the back end of the insulating body, and wrapping the soldering portions, wherein a protruding portion protrudes from a front end of the insulating block forward and enters each of the depressed portions, and the stopping portions are stopped in front of the protruding portion.

2. The electrical connector according to claim 1, wherein each of the stopping portions punctures a plate surface of the corresponding connection portion and extends backward.

3. The electrical connector according to claim 1, wherein each of the depressed portion is depressed from a back end surface of the insulating body forward, and a distance exists between the depressed portion and each of a top wall and a bottom wall of the terminal slot.

4. The electrical connector according to claim 1, wherein the depressed portion is depressed from the two side walls of each of the terminal slots, stopping portions protrude separately from two opposite sides of the connection portion of each of the terminals along opposite directions, the two stopping portions are disposed along a direction from front to rear, and the two stopping portions correspondingly resist inner wall surfaces of the two depressed portions.

5. The electrical connector according to claim 1, wherein an accommodating space is depressed from a back end surface of the insulating body forward, a circuit board is partially accommodated in the accommodating space, the soldering portion of each of the terminals is soldered to one end of the circuit board, and the insulating block, the soldering portions and the circuit board are insert molded as integrally, and fill the accommodating space.

6. The electrical connector according to claim 1, further comprising a metal shell wrapping the insulating body, wherein the metal shell is formed in a drawing manner, the insulating block is partially located in the metal shell, and the metal shell, the insulating body and the insulating block are fixed as a unit.

7. The electrical connector according to claim 1, wherein the connection portion of each of the terminals is provided with a retaining portion close to the soldering portion, the retaining portion and an inner wall surface of the corresponding terminal slot are in interference fit, and the stopping portion protrudes from a plate surface of the retaining portion.

8. The electrical connector according to claim 7, wherein a supporting portion protrudes from each of the connection portions close to the contact portion, the supporting portion is located between the contact portion and the retaining portion, the supporting portion protrudes toward a horizontal center surface of the insulating body, and the supporting portion resists the inner wall surface of the terminal slot.

9. The electrical connector according to claim 1, wherein two rows of terminal slots are provided to run through the insulating body along a direction from front to rear, the terminals are correspondingly located at the two rows of terminal slots and are arranged into an upper row and a lower row in the insulating body, a shielding sheet is inserted into the insulating body and is located between the upper and lower rows of terminals, and a plate surface of each of the terminals is perpendicular to a plate surface of the shielding sheet.

10. The electrical connector according to claim 9, wherein the shielding sheet has a base portion located at a back end of the terminal slot, a latch arm extends from each of two opposite sides of the base portion forward, a hollowing portion is depressed from each of two opposite sides of the insulating body and is in communication with the insertion space, the latch arms are respectively accommodated in the hollowing portions and stretched into the insertion space, two retaining arms protrude from the base portion between the two latch arms, each of the retaining arms is located between a terminal at the outermost side and a terminal adjacent to the terminal at the outermost side, the insulating body is provided with two fixing slots between the two rows of terminal slots, and the two retaining arms are correspondingly fixed to the two fixing slots.

11. An electrical connector for mating a mating connector, comprising:

an insulating body, having an insertion space located at a front end thereof for the mating connector to be inserted therein, and a plurality of terminal slots in communication with the insertion space, wherein each of the terminal slots has two side walls disposed opposite to each other, a depressed portion is depressed from at least one of the side walls, and the depressed portion is laterally in communication with the terminal slot; and a plurality of terminals, respectively assembled to the terminal slots, wherein each of the terminals has one end provided with a contact portion located in the insertion space and mating the mating connector, and the other end provided with a soldering portion protruding from the insulating body, the terminal has a connection portion located between the contact portion and the soldering portion, a stopping portion protrudes from at least one side of the connection portion toward the depressed portion, and the stopping portion resists an inner wall surface of the depressed portion, wherein each of the depressed portions is depressed from a back end surface of the insulating body forward, and a distance exists between the depressed portion and each of a top wall and a bottom wall of the terminal slot.

12. The electrical connector according to claim 11, wherein each of the stopping portions punctures a plate surface of the connection portion of the corresponding terminal and extends backward.

13. The electrical connector according to claim 11, wherein depressed portions are separately depressed from the two side walls of each of the terminal slots, stopping portions protrude respectively from two opposite sides of the connection portion of each of the terminals along opposite directions, the two stopping portions are disposed along a direction from front to rear, and the two stopping portions correspondingly resist inner wall surfaces of the two depressed portions.

14. The electrical connector according to claim 11, wherein each of the connection portions is provided with a retaining portion close to the soldering portion, the retaining portion and an inner wall surface of the terminal slot are in interference fit, and the stopping portion protrudes from a plate surface of the retaining portion.

15. The electrical connector according to claim 14, wherein a supporting portion protrudes from the connection portion of each of the terminals close to the contact portion, the supporting portion is located between the contact portion and the retaining portion, the supporting portion protrudes toward a horizontal center surface of the insulating body, and when the mating connector is not inserted into the insertion space, the supporting portion resists the inner wall surface of the terminal slot.

16. The electrical connector according to claim 11, wherein two rows of terminal slots are provided to run through the insulating body along a direction from front to rear, the terminals are correspondingly located at the two rows of terminal slots and are arranged into two rows in the insulating body, a shielding sheet is inserted into the insulating body and is located between the two rows of terminals, and a plate surface of each of the terminals is perpendicular to a plate surface of the shielding sheet.

17. The electrical connector according to claim 16, wherein the shielding sheet has a base portion located at a back end of the terminal slot, a latch arm extends from each of two opposite sides of the base portion forward, a hollowing portion is depressed from each of two opposite sides of the insulating body and is in communication with the insertion space, the latch arms are respectively accommodated in the hollowing portions and stretched into the insertion space to cooperate with the mating connector, two retaining arms protrude from the base portion between the two latch arms, each of the retaining arms is located between a terminal at the outermost side and a terminal adjacent to the terminal at the outermost side, the insulating body is provided with two fixing slots between the two rows of terminal slots, and the two retaining arms are correspondingly fixed to the two fixing slots.

18. An electrical connector for mating a mating connector, comprising:

an insulating body, having an insertion space located at a front end thereof for the mating connector to be inserted therein, and a plurality of terminal slots in communication with the insertion space, wherein each of the terminal slots has two side walls disposed opposite to each other, a depressed portion is depressed from at least one of the side walls, and the depressed portion is laterally in communication with the terminal slot; and a plurality of terminals, respectively assembled to the terminal slots, wherein each of the terminals has one end provided with a contact portion located in the insertion space and mating the mating connector, and the other end provided with a soldering portion protruding from the insulating body, the terminal has a connection portion located between the contact portion and the soldering portion, a stopping portion protrudes from at least one side of the connection portion toward the depressed portion, and the stopping portion resists an inner wall surface of the depressed portion, wherein an accommodating space is depressed from a back end surface of the insulating body forward, a circuit board is partially accommodated in the accommodating space, the soldering portions are soldered to one end of the circuit board, the insulating block, the soldering portions and the circuit board are insert molded integrally, and fill the accommodating space, a front end of the insulating block is integrally formed with a protruding portion entering each of the depressed portion, and the stopping portions are stopped at a front end of the corresponding one of the protruding portions.

19. The electrical connector according to claim 18, wherein a cable is soldered to another end of the circuit board, so as to be electrically connected to the terminals, and the insulating block wraps and fixes a front end of the cable.

* * * * *